US006244732B1

(12) United States Patent
Futami et al.

(10) Patent No.: US 6,244,732 B1
(45) Date of Patent: Jun. 12, 2001

(54) LAMP

(75) Inventors: Takashi Futami; Teruo Koike; Yoshifumi Kawaguchi, all of Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/293,719

(22) Filed: Apr. 16, 1999

(30) Foreign Application Priority Data

Apr. 17, 1998 (JP) ..... 10-107880

(51) Int. Cl.[7] ..... F21V 5/00
(52) U.S. Cl. ..... 362/328
(58) Field of Search ..... 362/328, 331, 362/335, 336, 337, 338, 341, 346, 298, 299, 302, 304, 516, 520

(56) References Cited

U.S. PATENT DOCUMENTS 1,393,573 * 10/1921 Ritter ..... 362/337
1,614,027 * 1/1927 Graf ..... 362/302
3,732,417 5/1973 Nordquist et al. .
4,851,968 7/1989 Nino et al. ..... 362/299

FOREIGN PATENT DOCUMENTS 2210157 7/1994 (FR) .
9403829 2/1994 (WO) .

* cited by examiner

*Primary Examiner*—Y. Quach
(74) *Attorney, Agent, or Firm*—Ostrolenk, Faber, Gerb & Soffen, LLP

(57) ABSTRACT

There is provided a lamp composed of a light source, a tilted ellipsoidal rotation surface reflector, and an annular cylindrical lens. The tilted ellipsoidal rotation surface reflector is formed of an ellipsoidal rotation surface emerging when an ellipsoid, having a first focal line located on the center axis of the light source and adjacent the light source and a second focal point located on an oblique line passing through the first focal point and tilted appropriately from the light-source center axis and assumed on a plane containing the light-source center axis and the oblique line, is rotated around the light-source center axis. The annular cylindrical lens is obtained by rotating, around the light-source center axis, the cross-sectional configuration of an aspheric lens having a focal point adjacent the second focal point of the ellipsoid and having an optical axis nearly parallel to the light-source center axis.

12 Claims, 4 Drawing Sheets

LAMP

BACKGROUND OF THE INVENTION

1. Field of the Invention

The present invention relates to a lamp and, more particularly, to a lamp suitable for use as an illumination lamp for a vehicle such as a head lamp or fog lamp, a signal lamp for a vehicle such as a tail lamp or turn signal lamp, a signal lamp for road traffic, or a signal lamp for railway traffic.

2. Background Art

FIGS. 1 to 3 show conventional lamps of this type. A lamp 90 shown in FIG. 1 basically includes: a light source 91; a revolutional paraboloidal reflector 92 having the light source 91 disposed at a focal point thereof; and a lens 93 with a lens cut 93*a*. A light beam from the light source 91 is reflected by the revolutional paraboloidal reflector 92 to form a parallel light beam. The reflected light beam is diffused properly by the lens cut 93*a* of the lens 93 to provide a desired light distribution property.

A lamp 80 shown in FIG. 2 includes a light source 81; a reflector composed of a composite reflecting surface 82; and a lens 83. The composite reflecting surface 82 has a plurality of cylindrical parabolic reflecting surfaces that are arranged to have a parabolic configuration in a vertical cross section taken when the lamp 80 is in a mounted state and have a linear configuration in a horizontal cross section (the state shown in the drawing). The lens 83 has no lens cut so that it is see-through. In the lamp 80, the composite reflecting surface 82 provides the light distribution property by itself.

A lamp 70 shown in FIG. 3 includes: a light source 71; a reflector composed of an elliptic reflecting surface 72 having the light source 71 disposed at a first focal point thereof; an aspheric lens 73; and a shade 74 provided if necessary. The elliptic reflecting surface is composed of a spheroid, a composite elliptic surface, or an elliptic free-form surface. In the arrangement, the aspheric lens 73 projects, under magnification, a light source image formed by converging a light beam at a second focal point to provide an irradiating light beam. The lamp 70 of the type using the elliptic reflecting surface 72 is termed a projector type lamp. The light distribution property is obtained by covering an unwanted portion with the shade 74.

In the lamp 90 shown in FIG. 1, however, the lens cut 93*a* should be formed to have high optical intensity, so that a significant variation is produced in the thickness of the lens 93. This degrades the transparency of the lens and makes it impossible to provide an appearance with enhanced clarity and sense of depth, which is currently preferred on the market.

It is possible to impart an appearance with enhanced clarity to the lamp 80 shown in FIG. 2, since the lens 83 without a lens cut is see-through. However, since the composite reflecting surface 82 positioned at a recessed portion forms a light distribution property, the formation of the light distribution property is limited by such a factor as difficulty in determining the light distribution property in the direction of width.

The lamp 70 shown in FIG. 3 is difficult to mount because of its increased depth dimension. Moreover, the aspheric lens 73 having a small outer diameter leads to a reduced light-emitting area. Therefore, the lamp 70 used as a headlight is inferior in visibility when viewed from an oncoming vehicle.

Each of the conventional lamps 70, 80, and 90 with the aforesaid structures is generally in wide use. Hence, it is impossible to distinguish them from other items and achieve novelty in terms of design. Furthermore, since the coefficient of use of a luminous flux from the light source is dependent on the depth dimension, the coefficient of use is lowered if the lamp is reduced in thickness.

SUMMARY OF THE INVENTION

It is therefore an object of the present invention to provide a lamp with an unprecedented and novel design including an annular cylindrical lens and a central aspheric lens.

Another object of the present invention is to provide a lamp having a light distribution property free from constraints and exhibiting enhanced flexibility particularly in the horizontal direction.

Still another object of the present invention is to provide a lamp having a given light-emitting area and improved visibility when viewed from an oncoming vehicle.

Yet another object of the present invention is to provide a lamp wherein the coefficient of use of a luminous flux from the light source is unaffected by the depth dimension.

One aspect of the present invention is to provide a lamp comprising: a light source; a tilted ellipsoidal rotation surface reflector formed of an ellipsoidal rotation surface emerging when an ellipsoid, having a first focal point located on a center axis of the light source and adjacent the light source and a second focal point located on an oblique line passing through the first focal point and tilted appropriately from the light-source center axis and assumed on a plane containing the light-source center axis and the oblique line, is rotated around the light-source center axis; and an annular cylindrical lens being obtained by rotating, around the light-source center axis, a cross-sectional configuration of an aspheric lens having a focal point adjacent the second focal point of the ellipsoid and an optical axis nearly parallel to the light-source center axis.

Since the annular cylindrical lens occupying a large area is present at the front face of the lamp, the annular cylindrical lens having a curvature only in the direction of radiation achieves the enlargement of the reflector only in the direction of radiation. This also achieves the effect of providing a lamp with an unprecedented and novel appearance.

In terms of performance, the reflector formed of the tilted ellipsoidal rotation surface reduces the depth dimension, thereby achieving the effects of reducing the thickness of the whole lamp and improving the mountability thereof. Moreover, since light from the single light source forms an image at the annular second focal point, there can be achieved the effects of reducing the temperature of the annular cylindrical lens, allowing the formation of the annular cylindrical lens from a resin, and lowering cost.

At this time, the position of the annular cylindrical lens is preferably determined such that the second focal point of the ellipsoid is within a range extending from the focal point of the aspheric lens to the front end thereof.

Preferably, an aspheric lens having a focal point adjacent the light source is disposed in a hole formed in the center of the annular cylindrical lens. This further increases the coefficient of use of light from the light source.

The lens may have at least a part thereof formed in a Fresnel configuration.

Respective annular shades each for allowing the passage of at least a part of reflected light and direct light may be disposed adjacent the annular second focal point of the tilted ellipsoidal rotation surface reflector and between the aspheric lens and the light source. This enables free control of the light distribution property.

A revolutional paraboloidal reflector having a focal point at the light source may be disposed coaxially with the light-source center axis to correspond to the hole formed in the center of the annular cylindrical lens.

The lamp may have a lens holder portion and the annular shade and the lens holder portion are in a color other than the color of the annular cylindrical lens. This solves the problem of pseudo lighting There may be further provided: a revolutional paraboloidal reflector having a focal point at the light source and an optical axis identical with the light-source center axis to correspond to a hole formed in the center of the annular cylindrical lens; and a prism lens corresponding to light from the revolutional paraboloidal reflector.

A filter in the form of a cap for diffusing or coloring light from the light source may be disposed between the light source and each of the tilted ellipsoidal rotation surface reflector and the revolutional paraboloidal reflector.

DETAILED DESCRIPTION OF THE PREFERRED EMBODIMENTS

Figure 1:
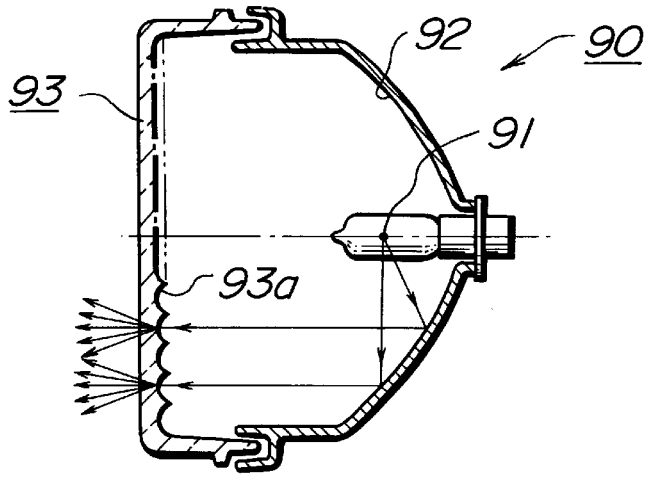
Fig. 1 Prior Art
FIG. 1 is a cross-sectional view showing a conventional embodiment.
Figure 2:
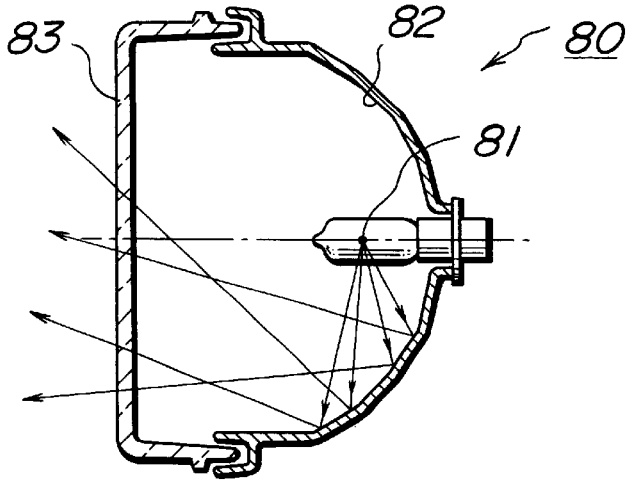
Fig. 2 Prior Art
FIG. 2 is a cross-sectional view showing another conventional embodiment.
Figure 3:
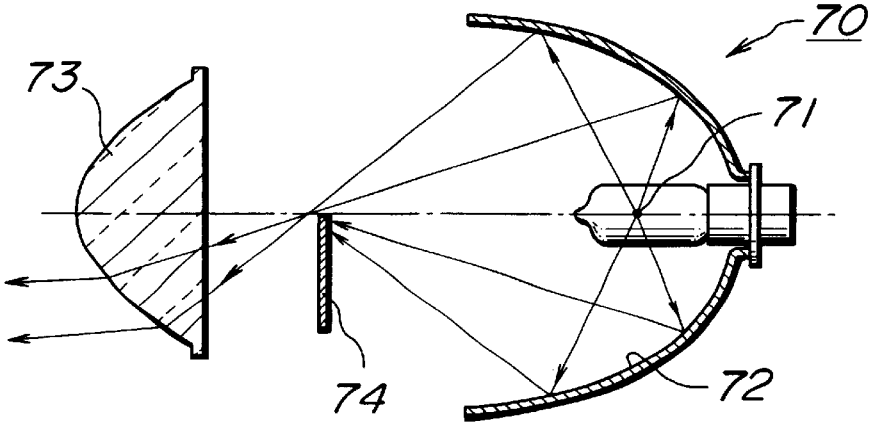
Fig.3 Prior Art
FIG. 3 is a cross-sectional view showing still another conventional embodiment.
Figure 4:
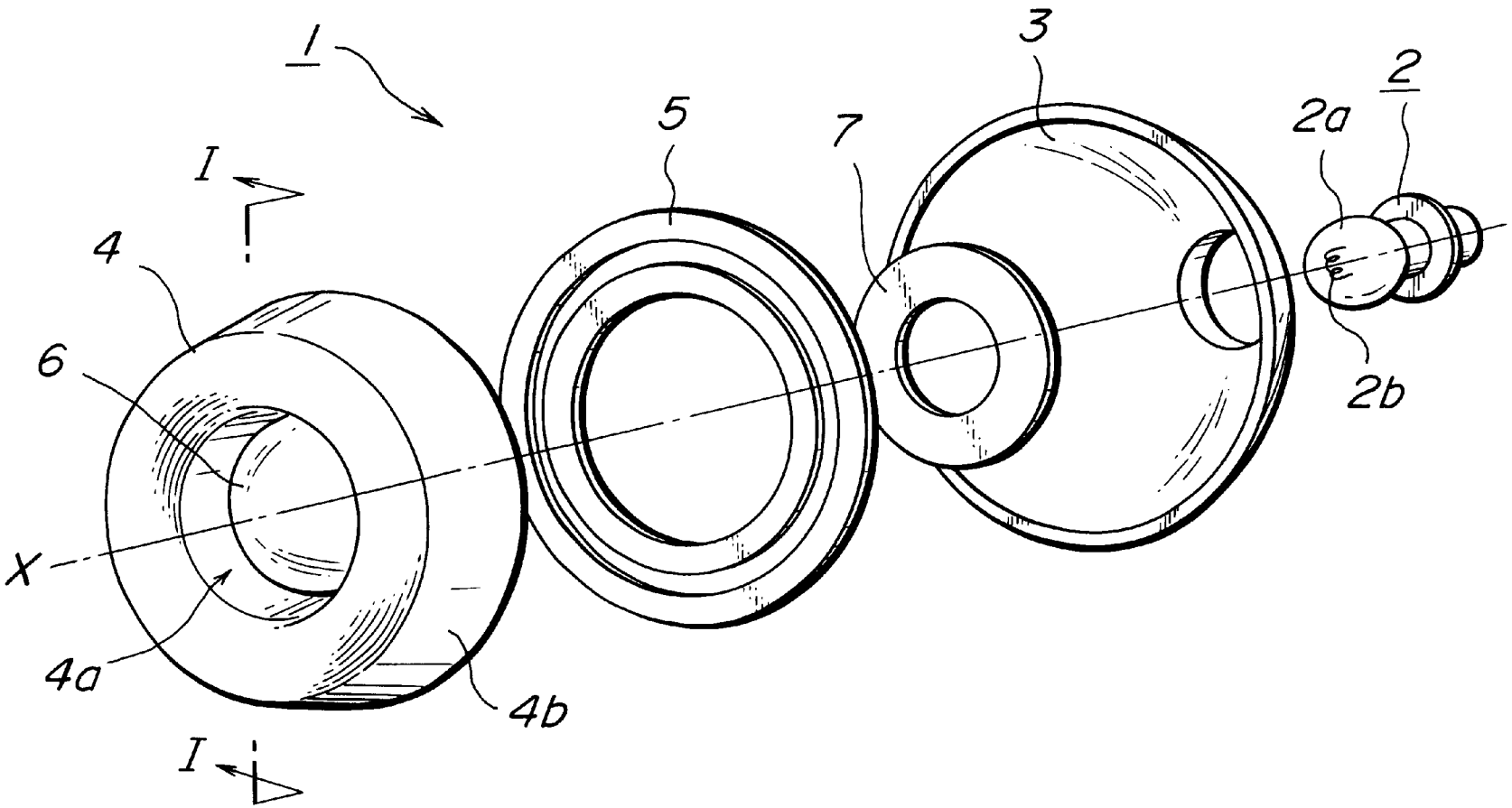
FIG. 4 is a perspective view showing a principal portion of a lamp according to a first embodiment of the present invention.
Figure 5:
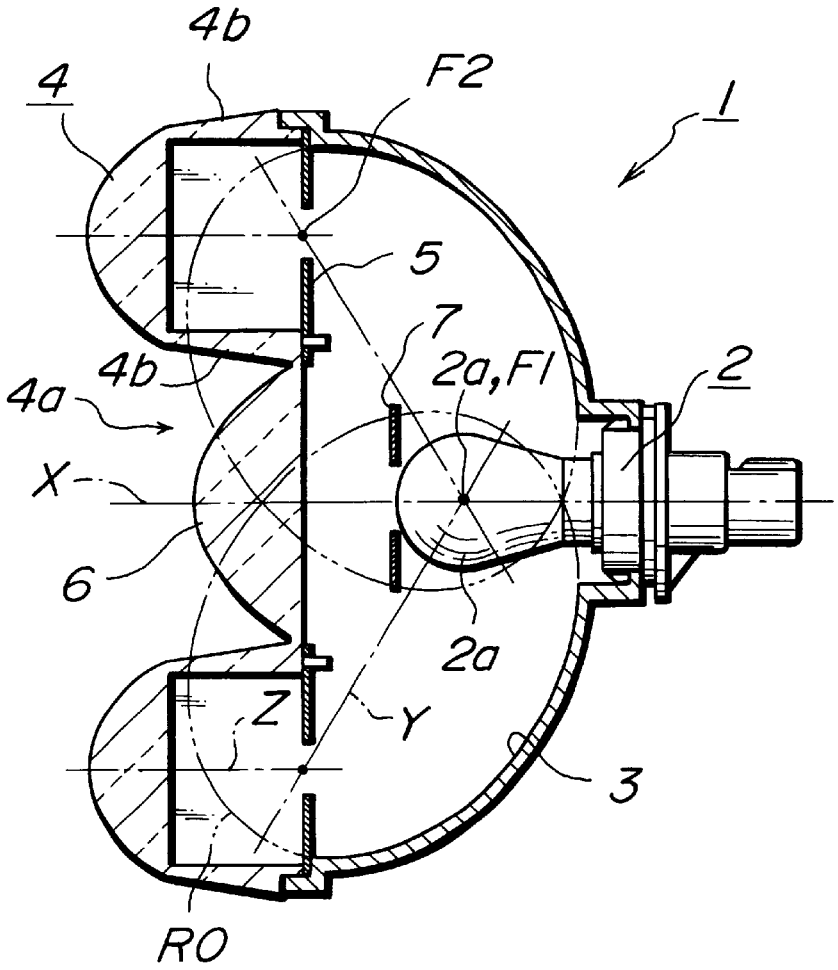
FIG. 5 is a cross-sectional view taken along the line I—I of FIG. 1.

The present invention will now be described in detail with reference to the drawings which illustrate the embodiments thereof. In FIGS. 4 and 5, a reference numeral 1 denotes a lamp according to the first embodiment of the present invention. The lamp 1 comprises: a light source 2; a tilted ellipsoidal rotation surface reflector 3; and an annular cylindrical lens 4.

The light source 2 consists of a bulb 2*a* composed of a glass bulb or the like and a light-emitting source 2*b* located on a light-source center axis X, which is the center of the bulb 2*a*. In this case, the light source 2 is composed of any one selected from an incandescent lamp, a discharge lamp, and the like. In the case of selecting an incandescent lamp to compose the light source 2, it may have a double filament. The first embodiment will be described with reference to the light-emitting source 2*b* located on the light-source center axis X.

A description will be given to a method of defining the tilted ellipsoidal rotation surface reflector 3. A first focal point F1 is positioned at the light-emitting source 2*b* on the light-source center axis X. Then, an oblique line Y passing through the first focal point F1 and tilted appropriately from the light-source center axis X is assumed. A second focal point F2 is positioned on the oblique line Y. Then, there is assumed an appropriate ellipsoid RO on a plane containing the oblique line Y and the light-source center axis X, which has its focal points at the first and second focal points F1 and F2. When the ellipsoid RO is rotated around the light-source center axis X, a locus results from the rotation of the tilted ellipsoid. The tilted ellipsoidal rotation surface reflector 3 is formed of a reflecting surface which emerges from the locus when the lamp 1 is viewed from the front side.

A description will be given to a method of defining an aspheric annular cylindrical lens 4 according to the present invention. The aspheric lens of which a focal point is at or adjacent the second focal point F2 of the ellipsoid RO, of which optical axis Z is nearly parallel to the light-source center axis X, and of which a focal length is 10 to 60 mm is designed. When the cross-sectional configuration of the aspheric lens on a plane containing the optical axis Z and the light-source center axis X is rotated around the light-source center axis X, the annular cylindrical lens 4 according to the present invention is obtained.

The position of the annular cylindrical lens 4 disposed in the lamp 1 as a finished product is moved appropriately along the optical axis Z depending on the light distribution property required of the lamp 1, such as the angle at which an irradiating light beam is radiated. The range of the movement is such that the second focal point F2 is within the range extending from the focal point of the annular cylindrical lens 4 to the front end thereof. The foregoing is the basic structure of the lamp 1 according to the present invention.

In the lamp 1 thus structured, the image of the light-emitting source 2*b* reflected by the tilted ellipsoidal rotation surface reflector 3 is focused on the second focal point F2 that is annular, so that the image is also annular. Then, the annular image of the light-emitting source 2*b* is projected in the direction of irradiation by means of the annular cylindrical lens 4 having the annular focal point. Accordingly, the light distribution property presented by the lamp 1 also has an annular configuration in which light is not basically distributed to the center.

However, since the image of the light-emitting source 2*b* is normally projected under magnification according to the light distribution property, the center portion to which light has not been distributed is supplied with light from the surroundings at an appropriate distance from the lamp 1. As a result, a circular light distribution property is obtained. At this time, if an annular shade 5 for shielding an unwanted portion in terms of the light distribution property is provided along the annular second focal point F2, the light distribution property can be changed freely.

In the first embodiment, a central aspheric lens 6 is preferably provided to further increase the coefficient of use of light from the light source 2. The central aspheric lens 6 is for coinciding the optical axis with the light-source center axis X and positioning the focal point at or adjacent the light-emitting source 2*b* of the light source 2.

In the arrangement, the central aspheric lens 6 allows the light from the light-emitting source 2*b* which is not captured by the tilted ellipsoidal rotation surface reflector 3 to be used as an irradiating light beam. In addition, the lens 6 allows the entire front face of the lamp 1 to emit light since the lens 6 is disposed in a hole 4*a* formed in the center of the annular cylindrical lens 4. At this time, if it is necessary to change the light distribution property, as described above, a central shade 7 can also be provided optionally for the light-emitting source 2*b*.

In the case where the annular shade 5 is provided or where the annular shade 5 and the central shade 7 are provided, if the same color imparted to the frame of an automobile is imparted to those faces of the shades 5 and 7 in opposing relation to the lenses 4 and 6, the colored shades 5 and 7 are viewed under magnification through the lenses 4 and 6 during the daytime or the like when the lamp is in the OFF state, so that the lamp 1 is viewed in the same color as the frame of the automobile. At this time, if the same color is imparted to the lens holder portion 4*b* of the annular cylindrical lens 4, the effect is further enhanced.

If each of the annular shade 5 and the central shade 7 is colored in black, the lenses 4 and 6 are viewed in black when the light source 2 is in the OFF state. As a result, it becomes possible to reduce the occurrence of so-called pseudo lighting caused by solar light incident on the faces of the lenses 4 and 6. This prevents false recognition if the lamp 1 is used as, e.g., a traffic signal light. In this case, if the lamp 1 is designed such that the color of the light emitted from the lamp 1 is determined by a cap-shaped filter 10 and the lenses 4 and 6 are formed colorless, as will be described below, the effect is further enhanced.

Figure 6:
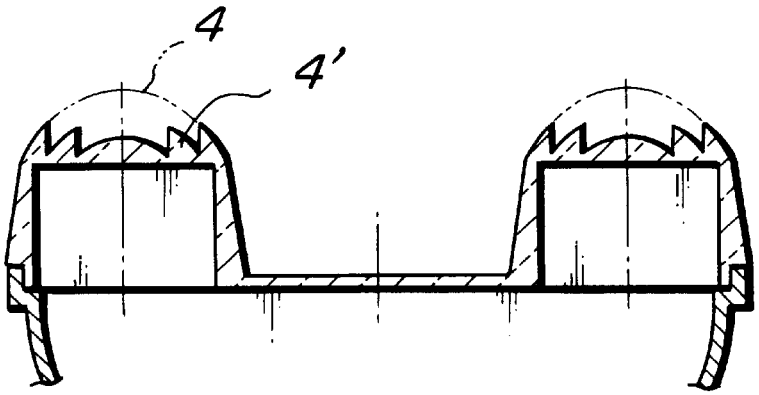
FIG. 6 is a cross-sectional view showing a principal portion of a lamp according to a second embodiment of the present invention.
Figure 7:
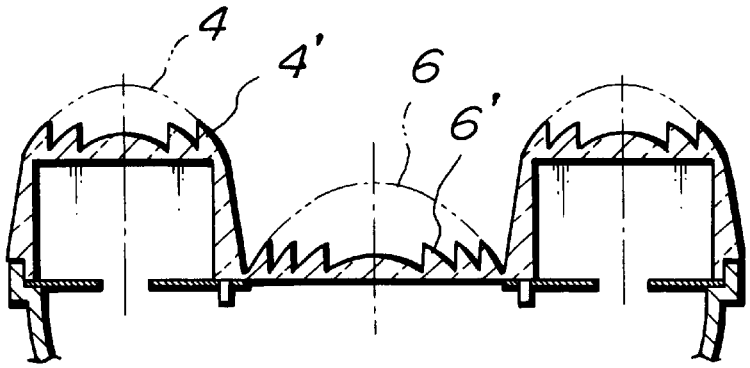
FIG. 7 is a cross-sectional view showing a principal portion of a lamp according to a third embodiment of the present invention.

FIGS. 6 and 7 show respective principal portions of the second and third embodiment of the present invention. Here, if the lamp 1 is provided only with the annular cylindrical lens 4, the annular cylindrical lens 4 may be formed in a Fresnel configuration to provide an annular Fresnel lens 4', as shown in FIG. 6 illustrating the second embodiment. If the central aspheric lens 6 is provided in addition to the annular cylindrical lens 4, each of the annular cylindrical lens 4 and the central aspheric lens 6 may be formed in the Fresnel configuration to provide the annular Fresnel lens 4' and an aspheric Fresnel lens 6', as shown in FIG. 7 illustrating the third embodiment. Alternatively, it is also possible to form either one of the annular cylindrical lens 4 and the central aspheric lens 6 in the Fresnel configuration, though the drawing thereof is omitted.

The formation of the lens or lenses in the Fresnel configuration may also be performed by reducing the pitch, which is usually practiced as a technique for Fresnel lens formation, to provide the annular cylindrical lens 4 and/or central aspheric lens 6 that can be seen as if in the form of a plate. It is also possible to, e.g., comparatively increase the pitch for Fresnel lens formation to the order of 3 mm and thereby form the lens or lenses with such clarity and luster as those of crystal glass.

Figure 8:
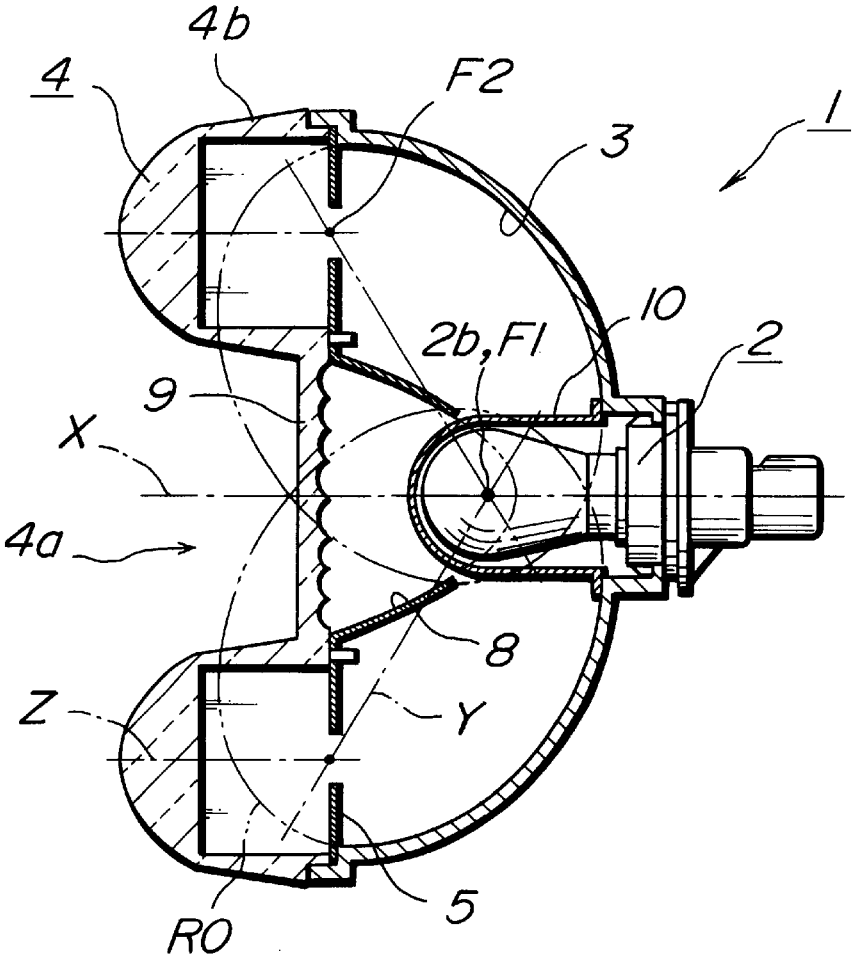
FIG. 8 is a cross-sectional view showing a lamp according to a fourth embodiment of the present invention.

FIG. 8 shows the fourth embodiment of the present invention. In the fourth embodiment, a revolutional paraboloidal reflector 8 having a focal point at the light-emitting source 2*b* and using the light-source center axis X as its optical axis is provided to correspond to the hole 4*a* of the aforesaid annular cylindrical lens 4 (or, alternatively, the annular Fresnel lens 4'). Accordingly, light radiated through the hole 4*a* forms a parallel light beam. The hole 4*a* is provided with a prism lens 9 for appropriately diffusing the parallel light beam, which is similar to that provided in the conventional lamp (see FIG. 6) using the revolutional paraboloidal reflector.

In FIG. 8, a reference numeral 10 denotes a cap-shaped filter. The cap-shaped filter 10 is configured as a cap to cover the light source 2 and frost-finished. This causes proper diffusion in the light radiated from the light source 2 and alleviates uneven illuminance in the light distribution property. In the case where the filter 10 is colored, the illuminating light beam from the lamp 1 is colored. Optionally, the cap-shaped filter 10 may also be provided in the lamp 1 according to the first embodiment.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A lamp comprising:

a light source having a center axis;

a tilted ellipsoidal rotation surface reflector, said reflector defined by an ellipsoidal rotation surface generated from rotating an ellipsoid, having a first focal point located on the center axis and adjacent said light source and a second focal point located on an oblique line passing through said first focal point and tilted appropriately from the center axis on a plane containing the center axis and said oblique line, around the center axis; and an annular cylindrical lens defined by rotating a cross section of an ashpheric lens around the center axis, said aspheric lens having a focal point adjacent said second focal point of said ellipsoid and an optical axis nearly parallel to the center axis.

2. The lamp according to claim 1, wherein said annular cylindrical lens is positioned such that the second focal point of said ellipsoid is within a range extending from the focal point of said annular cylindrical lens to a front end of the cylindrical lens.

3. The lamp according to claim 1, further comprising a second aspheric lens having a focal point adjacent the light source, said second aspheric lens disposed in a central opening of said annular cylindrical lens.

4. The lamp according to claim 1, wherein said annular cylindrical lens has at least a part thereof formed in a Fresnel configuration.

5. The lamp according to claim 1, further comprising respective annular shades, each for allowing the passage of at least a part of reflected light and direct light, each respectively disposed adjacent said second focal point of said reflector and between said annular cylindrical lens and the light source.

6. The lamp according to claim 1, further comprising a prism lens having a focal point adjacent to the light source, said from lens disposed in a central opening of said annular cylindrical lens.

7. The lamp according to claim 6, further comprising a revolutional paraboloidal reflector having a focal point at said light source, said paraboloidal reflector disposed coaxially with the center axis to correspond to the central opening of said annular cylindrical lens.

8. The lamp according to claim 7, wherein a filter in the form of a cap for diffusing or coloring light from said light source is disposed between said light source and each of said tilted ellipsoidal rotation surface reflector and said revolutional paraboloidal reflector.

9. The lamp according to claim 1, further comprising an annular shade for allowing the passage of at least a part of reflected light, said annular shade disposed adjacent to said second focal point of said reflector.

10. The lamp according to claim 9, further comprising a lens holder portion connected to said annular cylindrical lens, wherein said annular shade and the lens holder portion are in a color other than a color of the annular cylindrical lens.

11. The lamp according to claim 1, further comprising:

a revolutional paraboloidal reflector having a focal point at said light source and an optical axis identical with the center axis to correspond to a central opening of said annular cylindrical lens; and a prism lens corresponding to light from said revolutional paraboloidal reflector.

12. The lamp according to claim 1, wherein the second focal point comprises an annular locus resulting from the rotation of the ellipsoidal rotation surface.

* * * * *